United States Patent [19]

Hakeem

[11] Patent Number: 5,076,442

[45] Date of Patent: Dec. 31, 1991

[54] SHOE ORGANIZATIONAL SYSTEM FOR CLOSETS

[76] Inventor: Carol Hakeem, 5409 Covey Creek Cir., Stockton, Calif. 95207

[21] Appl. No.: 665,897

[22] Filed: Mar. 7, 1991

[51] Int. Cl.[5] ..... A47F 5/00

[52] U.S. Cl. ..... 211/34; 211/94; 211/162; 211/35

[58] Field of Search ..... 211/162, 94, 34, 35, 211/28

[56] References Cited

U.S. PATENT DOCUMENTS

| | | | |
|---|---|---|---|
| 1,132,190 | 3/1915 | Kohout | 211/94 |
| 2,098,828 | 11/1937 | Ludwick | 211/162 X |
| 2,866,559 | 12/1958 | Byrne | 211/35 |
| 3,198,343 | 8/1965 | Pollock | 211/87 |
| 3,563,390 | 10/1969 | Kim | 211/35 |
| 4,008,807 | 2/1977 | Phillips | 211/162 X |
| 4,585,127 | 4/1986 | Benedict | 211/34 |

*Primary Examiner*—Robert W. Gibson, Jr.

*Attorney, Agent, or Firm*—Phillips, Moore, Lempio, Finley

[57] ABSTRACT

A shoe organizational system includes a slider assembly adapted to be mounted in a closet and a panel secured to a slide member of the slider assembly for movement between a retracted or storage position within the closet or an extended position for viewing shoe selection purposes. A plurality of horizontally disposed and vertically spaced shoe rack units are secured on one or both sides of the panel to extend thereacross. A plurality of pairs of laterally spaced shoe supports are secured on each of the shoe rack units to accommodate the storage of shoes thereon. A plurality of the systems can be mounted in side-to-side relationship in a closet, should the need arise.

16 Claims, 1 Drawing Sheet

SHOE ORGANIZATIONAL SYSTEM FOR CLOSETS

TECHNICAL FIELD

This invention relates generally to a system for storing shoes and more particularly to a shoe rack system mounted on a slidable panel for normal storage in a closet or the like.

BACKGROUND OF THE INVENTION

Systems for storing shoes in a home generally include shelves mounted in a closet and arranged to have pairs of shoes placed thereon. In addition to the difficulty of storage and removal, conventional systems of this type subject the shoes to abrasion and dust. Also, the system is limited in respect to the number of shoes that can be stored per unit area of a closet.

Another conventional system involves the use of a "hanging" flexible panel having pockets formed thereon whereby pairs of shoes may be inserted into the pockets for storage purposes. Although protecting the shoes, the latter type of system is cumbersome to use and does not fully expose the shoes for visual choice by the user. The system also requires an undue amount of closet area for shoe storage purposes.

SUMMARY OF THE INVENTION

An object of this invention is to provide an efficient, economical and non-complex shoe organizational system adapted to be mounted in a closet or the like to provide expeditious and full viewing access to shoes numerous by a user.

The shoe organizational system comprises an elongated slider assembly including a horizontally disposed support member having a slide member movably mounted thereon for permitting the slide member to be moved longitudinally from a retracted to an extended position. A vertically disposed shoe rack mounting panel has its upper end attached to the slide member for simultaneous movement therewith. Shoe rack means, preferably comprising a plurality of horizontally disposed and vertically spaced shoe rack units, are secured on one or both sides of the panel for removably mounting shoes thereon.

Thus, it can be appreciated that when the shoe organizational system is mounted in a closet, that the panel can be easily and expeditiously moved to its retracted or storage position in the closet. When the user desires to choose a pair of shoes, she or he need only extend the panel to place the shoes in full view for selection purposes.

BRIEF DESCRIPTION OF THE DRAWING

Other objects and advantages of this invention will become apparent from the following description and accompanying drawing wherein:

FIG. 1 is an isometric view illustrating a shoe organizational system embodying this invention with a shoe rack mounting panel thereof being shown in its extended position;

DESCRIPTION OF THE PREFERRED EMBODIMENT

FIG. 1 illustrates a shoe organizational system 10 comprising an elongated slider assembly 11 adapted to move a shoe rack assembly 12 between its illustrated extended position and a retracted or storage position within the confines of a closet or the like. As described more fully hereinafter, the shoe rack assembly is adapted to have a plurality of pairs of shoes removably mounted thereon whereby the user is enabled to fully view the shoes when the shoe rack assembly is moved to its illustrated extended position. The system is adapted to be mounted in a closet (FIG. 3) or the like whereby the shoe rack assembly can be pushed-in manually to its retracted position for storage purposes in the closet.

Figure 2:
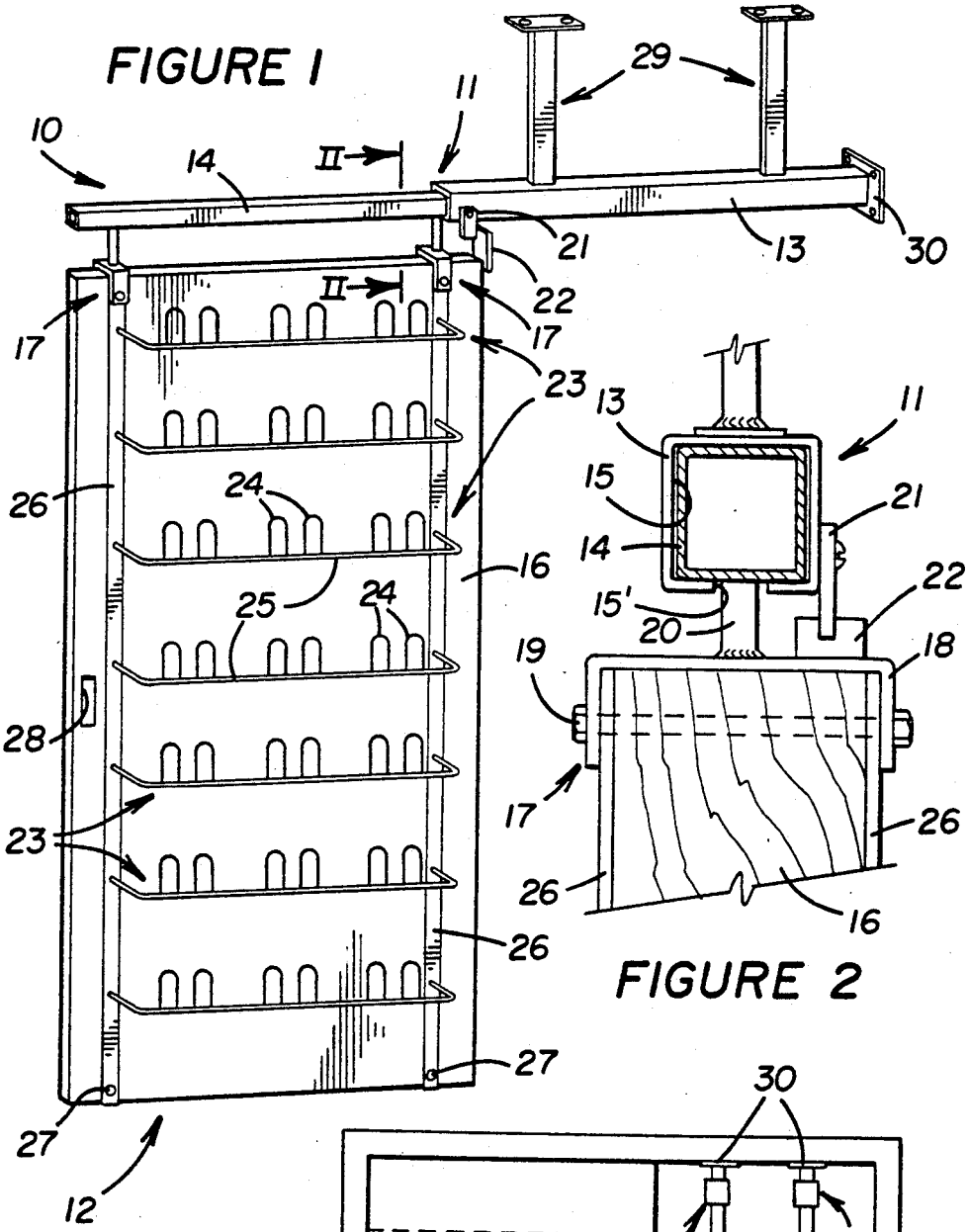
FIG. 2 is an enlarged cross-sectional view, taken in the direction of arrows II—II in FIG. 1.

As shown in FIGS. 1 and 2, slider assembly 11 comprises a horizontally disposed support member 13 having a horizontally disposed slide member 14 movably mounted therein. The guide means for movably mounting the slide member on the support member comprises an elongated channel 15, defined in support member 13 and throughout its entire length and having slide member 14 telescopically and slidably mounted therein. The tubular support and slide members preferably each constitute steel tubing that may have cross-sections other than the illustrated square cross-sections, e.g., circular. Other types of slider assemblies could be utilized, such as a plurality of standard rollers (not shown) secured on the upper edge of the shoe rack assembly and mounted for sliding or rolling movement in channel 15.

Shoe rack assembly 12 comprises a vertically disposed shoe rack mounting panel 16, preferably disposed vertically below slider assembly 11. The panel may be composed of any standard door material, such as a hollow core door construction that is standard in homes. The size of the panel will, of course, vary depending on the particular application and storage area in which the shoe organizational system is mounted. For example, the panel may have a height selected from the approximate range from four to six feet and a width selected from the approximate range from two to four feet.

Attachment means for securing an upper end of panel 16 to slide member 14 may comprise at least one bracket assembly 17 secured to the panel. In the embodiment illustrated in FIG. 1, a pair of longitudinally spaced bracket assemblies are secured adjacent to opposite upper ends of the panel. Further, each bracket assembly includes an inverted U-shaped bracket 18 straddled across and secured to the upper end of the panel by a cross-bolt 19 (FIG. 2).

The attachment means for attaching the panel to slide member 14 further includes a vertically disposed strut 20 secured between a respective bracket 18 and an underside of the slide member. The strut can be welded or otherwise suitably secured between the slide member and the bracket. A longitudinally extending slot 15' is formed through an underside of support member 13 to communicate with channel 15. Strut 20 is positioned to extend through and is guided within the slot.

If so desired, stop means can be provided for delimiting extension of slide member 14 relative to support member 13. For example and as shown in FIGS. 1 and 2, the stop means may comprise a first stop plate 21 secured forwardly and on one side of the support member and a second stop member 22 secured at a rearward and upper edge of panel 16. As shown, maximum extension of the slide tube and attached shoe rack assembly will function to engage stop plate 22 with stop plate 21 to prevent removal of the slide member from the support member.

Shoe rack assembly 12 further comprises a plurality of horizontally disposed and vertically spaced shoe rack units 23 secured on at least one side of panel 16 to extend thereacross. Each shoe rack unit comprises a plurality of pairs of laterally spaced standard shoe supports 24 secured thereon. Each shoe rack unit further comprises a U-shaped frame having a preselected number of shoe supports secured thereon. The frame and shoe supports may be formed from a suitable heavy-gauge steel wire formed into the desired shoe retaining configurations and coated with a suitable rubber or plastic material in a conventional manner.

The vertically disposed frames of the shoe rack units each have opposite ends thereof suitably secured to a pair of vertically disposed and laterally spaced steel mounting straps 26. The upper end of each mounting strap may be secured to panel 16 by the same bolt 19 that secures a flange of an overlying bracket 18 thereto (FIG. 2). Suitable fasteners 27 can be utilized to secure the lower IO ends of the straps to the panel.

Handle means, such as an illustrated finger slot 28, may be provided adjacent to a frontal edge of panel 16 (FIG. 1) for permitting manual grasping of the panel and movement of the panel between its retracted and extended positions. Mounting means for attaching support member 13 to a ceiling and/or wall, defining a closet or the like, is shown in FIG. 1 as comprising a pair of longitudinally spaced ceiling mounting brackets 29 and a single wall mounting plate 30. Other types of hardware for securing the support member in place are well-known to those skilled in the art.

Figure 3:
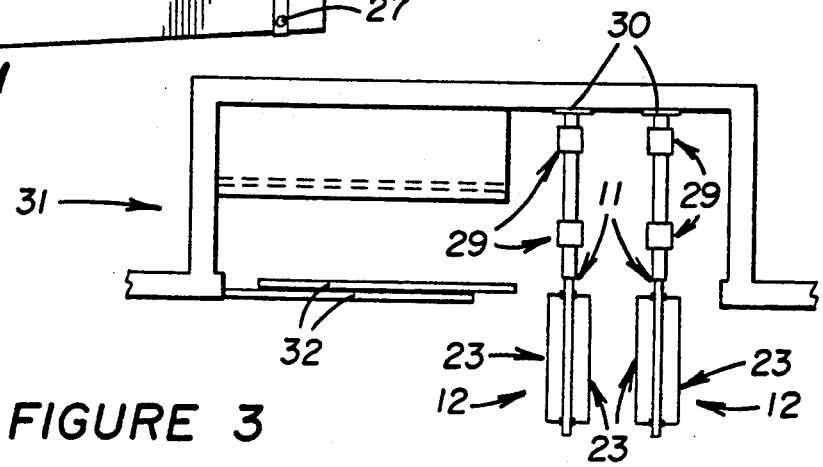
FIG. 3 is a top plan view of a closet with its ceiling removed to show the mounting of a pair of shoes organizational systems of this invention therein with the systems being shown in their extended positions.

FIG. 3 is a top plan view of a standard closet with the ceiling having been removed for illustration purposes. As shown, a pair of laterally adjacent shoe organizational systems 10 are each suitably attached within the illustrated closet by the above-described ceiling mounting brackets 29 and wall mounting plates 30. Shoe rack assemblies 12 are shown in their extended positions whereby the user is enabled to view the large collection of shoes mounted on shoe rack units 23.

As further illustrated, shoe rack units have been mounted on each side of each panel 16 whereby a substantial number of pairs of shoes can be stored on each panel for ready access. In the closet configuration illustrated in FIG. 3, a pair of sliding closet doors 32 are mounted on a frontal side of the closet in a conventional manner whereby they may be closed when the shoe rack assemblies are retracted into the closet for storage purposes. It should be obvious that the shoe organizational system of this invention may be used in standard enclosed closets (built-in), walk-in closets, or in free-standing cabinets, such as an armoire defining a "closet" therein.

The number and spacing of the shoe organizational systems is a matter of choice, depending on the particular closet application. Further, the system can be specially designed for newly constructed closets or adapted for use as an added fixture in an existing closet.

I claim:

1. A shoe organizational system for closets and the like comprising an elongated slider assembly including a horizontally disposed support member, a horizontally disposed slide member, and guide means for movably mounting said slide member on said support member for permitting said slide member to be moved longitudinally relative to said support member from a retracted position to an extended position, a vertically disposed shoe rack mounting panel, attachment means for securing an upper end of said panel to said slide member for simultaneous movement therewith when said slide member is moved relative to said support member between its retracted and extended positions, shoe rack means mounted on at least one side of said panel for removably mounting shoes thereon, said shoe rack means comprising a plurality of horizontally disposed and vertically spaced shoe rack units secured on said panel to extend thereacross, each of said shoe rack units having a plurality of pairs of laterally spaced shoe supports secured thereon, and handle means at a frontal edge of said panel for permitting manual grasping of said panel and movement of said panel between its retracted and extended positions.

2. The system of claim 2 wherien said guide means comprises an elongated channel defined in said support member and wherein said slide member is telescopically and slidably mounted in said channel.

3. The system of claim 2 wherein said attachment means comprises bracket means for securing said slide member to an upper end of said panel.

4. The system of claim 3 wherein said bracket means comprises a plurality of longitudinally spaced bracket assemblies.

5. The system of claim 4 wherein each fo said bracket assemblies includes an inverted U-shaped bracket straddled across and secured to the upper end of said panel and a strut secured between said slide member and said bracket.

6. The system of claim 5 wherein an underside of said support member has a longitudinally extending slot formed therethrough to communicate with said channel and wherein said strut extends through and is guided in said slot.

7. The system of claim 1 further comprising a pair of vertically disposed and laterally spaced mounting straps secured on said panel and wherein opposite ends of each of said shoe rack units are secured to said mounting straps.

8. The system of claim 1 wherein each of said shoe rack units comprises a U-shaped frame having said shoe supports secured thereon.

9. The system of claim 1 wherein both sides of said panel have a said shoe rack means mounted thereon.

10. The system of claim 1 wherein said panel has a height selected from the approximate range of from four to six feet and a width selected from the approximate range of from two to four feet.

11. The system of claim 1 further comprising mounting means secured on said support member for attaching said support member to at least one of a wall and a ceiling defining a closet or the like.

12. The system of claim 13 further comprising a closet defined by vertically disposed walls and a horizontally disposed ceiling and wherein said mounting means attaches said support member to at least one fo said walls and said ceiling.

13. A shoe organizational system for closets and the like comprising an elongated slider assembly including a horizontally disposed support member, a horizontally disposed slide member, and guide means for movably mounting said slide member on said support member for permitting said slide member to be moved longitudinally relative to said support member from a retracted position to an extended position, said guide means comprising an elongated channel defined in said support member and wherein said slide member is telescopically and slidably mounted in said channel, a vertically disposed shoe rack mounting panel, attachment means for securing an upper end of said panel to said slide member for simultaneous movement therewith when said slide member is moved relative to said support member between its retracted and extended positions, said attachment means comprising bracket means for securing said slide member to an upepr end of said panel and wherein said bracket means comprises a plurality of longitudinally spaced bracket assemblies and each of said bracket assemblies includes an inverted U-shaped bracket straddled across and secured to the upper end of said panel and a strut secured between said slide member and said bracket, and shoe rack means mounted on at least one side of said panel for removably mounting shoes thereon.

14. A shoe organizational system for closets and the like comprising an elongated slider assembly includign a horizontally disposed support member, a horizontally disposed slide member, and guide means for movably mounting said slide member on said support member for permitting said slide member to be moved longitudinally relative to said support member from a retracted position to an extended position, a vertically disposed shoe rack mounting panel, attachment means for securing an upper end of said panel to said slide member for simultaneous movement therewith when said slide member is moved relative to said support member between its retracted and extended positions, shoe rack means mounted on at least one side of said panel for removably mounting shoes thereon, said shoe rack means comprising a plurality of horizontally disposed and vertically spaced shoe rack units secured on said panel to extend thereacross, each of said shoe rack units having a plurality of pairs of laterally spaced shoe supports secured thereon, and a pair of vertically disposed and laterally spaced mounting straps secured on said panel and wherein opposite ends of each of said shoe rack units are secured to said mounting straps.

15. A shoe organizational system for closets and the like comprising an elongated slider assembly including a horizontally disposed support member, a horizontally disposed slide member, and guide means for movably mounting said slide member on said support member for permitting said slide member to be moved longitudinally relative to said support member from a retracted position to an extended position, a vertically disposed shoe rack mounting panel, attachment means for securing an upper end of said panel to said slide member for simultaneous movement therewith when said slide member is moved relative to said support member between its retracted and extended positions, and shoe rack means mounted on at least one side of said panel for removably mountign shoes thereon, said shoe rack means comprises a plurality of horizontally disposed and vertically spaced shoe rack units secured on said panel to extend thereacross, each fo said shoe rack units having a plurality of pairs of laterally spaced shoe supports secured theroen and each of said shoe rack units comprising a U-shaped frame having said shoe supports secured thereon.

16. A shoe organizational system for closets and the like comprising an elongated slider assembly including a horizontally disposed support member, a horizontally disposed slide member, and guide means for movably mounting said slide member on said support member for permitting said slide member to be moved longitudinally relative to said support member from a retracted position to an extended position, a vertically disposed shoe rack mounting panel, attachment means for securing an upper end of said panel to said slide member for simultaneous movement therewith when said slide member is moved relative to said support member between its retracted and extended positions, and shoe rack means mounted on at least one side of said panel for removably mounting shoes thereon, said shoe rack means comprising a plurality of horizontally disposed and vertically spaced shoe rack units secured on asid panel to extend thereacross, each of said shoe rack units having a plurality of pairs of laterally spaced shoe supports secured thereon and wherein both sides of said panel have a said shoe rack means mounted thereon.

* * * * *